United States Patent [19]

Reiss

[11] 4,320,275

[45] Mar. 16, 1982

[54] MICROWAVE OVEN WITH RESISTANCE HEATING UNIT

[75] Inventor: Willi Reiss, Nuremburg, Fed. Rep. of Germany

[73] Assignee: Licentia Patent-Verwaltungs-G.m.b.H., Frankfurt am Main, Fed. Rep. of Germany

[21] Appl. No.: 208,333

[22] Filed: Nov. 19, 1980

[30] Foreign Application Priority Data

Nov. 20, 1979 [DE] Fed. Rep. of Germany ..... 2946766

[51] Int. Cl.[3] ..... H05B 6/70

[52] U.S. Cl. ..... 219/10.55 B; 126/200; 126/21 A; 219/10.55 R

[58] Field of Search ..... 219/10.55 F, 10.55 R, 219/10.55 M, 10.55 D, 10.55 A; 126/200, 21 A

[56] References Cited

U.S. PATENT DOCUMENTS

| | | | |
|---|---|---|---|
| 3,276,138 | 10/1966 | Fritz | 219/10.55 R |
| 3,364,331 | 1/1968 | Johnson | 219/10.55 F |
| 3,440,385 | 4/1969 | Smith | 219/10.55 R |
| 3,656,469 | 4/1972 | Jung et al. | 126/21 A |
| 4,096,369 | 6/1978 | Tanak et al. | 219/10.55 R |
| 4,105,886 | 8/1978 | Baron et al. | 219/10.55 R |

FOREIGN PATENT DOCUMENTS 2715655 1/1978 Fed. Rep. of Germany .

*Primary Examiner*—Arthur T. Grimley
*Attorney, Agent, or Firm*—Spencer & Kaye

[57] ABSTRACT

A microwave oven has a cooking chamber provided with a microwave window covered by a glass-ceramic plate with the interposition of a seal. A microwave connecting housing adjoins the window externally of the cooking chamber. A microwave generating and guiding device bounds at least in part the space defined by the connecting housing for directing microwave energy into the cooking chamber. Further, an electric resistance heater is arranged in the cooking chamber. There are provided air inlet openings communicating with the space defined by the connecting housing for introducing pressurized air thereinto, whereby an air pressure is generated in the connecting housing for preventing cooking vapors and the like from reaching and soiling microwave generating and guiding components.

12 Claims, 5 Drawing Figures

MICROWAVE OVEN WITH RESISTANCE HEATING UNIT

BACKGROUND OF THE INVENTION

This invention relates to a combined oven which operates both on microwave heating and electric resistance heating and which further has a ventilating system as well as a device for the pyrolytic cleaning of the cooking chamber. The bottom of the cooking chamber is provided with a microwave window which is tightly covered by a glass-ceramic plate and below which there are arranged a microwave connecting housing and devices for generating and guiding the microwave energy.

An oven of the above-outlined type is conventional and is disclosed, for example, in German Offenlegungsschrift (Laid-Open Application) No. 2,715,655. It is well known that during baking or broiling by means of electric resistance elements, a significant amount of vapor mist is generated which penetrates through the smallest cracks and then, by precipitation, soils the oven components. Particularly in case of sensitive electric and electronic components such occurrences may adversely affect the operational reliability of the oven to a significant degree. In order to avoid such condensation deposits in the extremely sensitive devices that generate and guide the microwave energy, the glass-ceramic plate which covers the window provided in the bottom of the cooking chamber is secured to the bottom with the intermediary of a circumferential, high-temperature resistant seal. It has been found, however, that during normal operation of the cooking chamber such a seal absorbs vapor mist and gases and first stores the precipitated grease particles and the like. If then the cooking chamber of the oven is periodically submitted to a pyrolytic heat cleaning cycle during which, as known, temperatures in excess of 500° C. may be generated, such high temperatures cause the grease and similar material absorbed in the seal of the glass-ceramic plate to vaporize and thus escape from the seal. The grease vapor or other impure gases emanating from the seal escape in all directions and while doing so, also reach the microwave generating and guiding system underneath the glass-ceramic plate. There the grease vapor condensates and accumulates on sensitive components, such as the magnetron and the antenna of the microwave energy generating device. Over a period of time the precipitated particles lead to a soiling of the components to such an extent that a reliable operation is endangered and a premature breakdown of the apparatus can be expected.

SUMMARY OF THE INVENTION

It is an object of the invention to provide an improved oven of the above-outlined type in which a precipitation particularly of the gaseous vapors or impure gases emanating from the seal of the glass-ceramic base plate on components of the microwave energy generating and guiding device is prevented by means of simple structural measures.

This object and others to become apparent as the specification progresses, are accomplished by the invention, according to which, briefly stated, in the microwave connecting housing there is generated an air pressure which is directed towards the sealing zone of the glass-ceramic plate for preventing vaporized or gaseous substance emanating from the seal from contacting predetermined components of the oven.

By means of the invention it is achieved that the grease vapors and other impure gases diffused from the seal during the heat cleaning cycle are driven in a flow direction which is oriented away from the microwave energy generating and guiding device so that the vapors and gases are kept away from these sensitive components and therefore a precipitation on the sensitive components and the inherent soiling thereof cannot take place. In this manner the operational reliability and service life of the microwave generating components are significantly lengthened and the cost of maintenance and upkeep involved in such ovens is maintained low.

DESCRIPTION OF THE PREFERRED EMBODIMENTS

Figure 1:
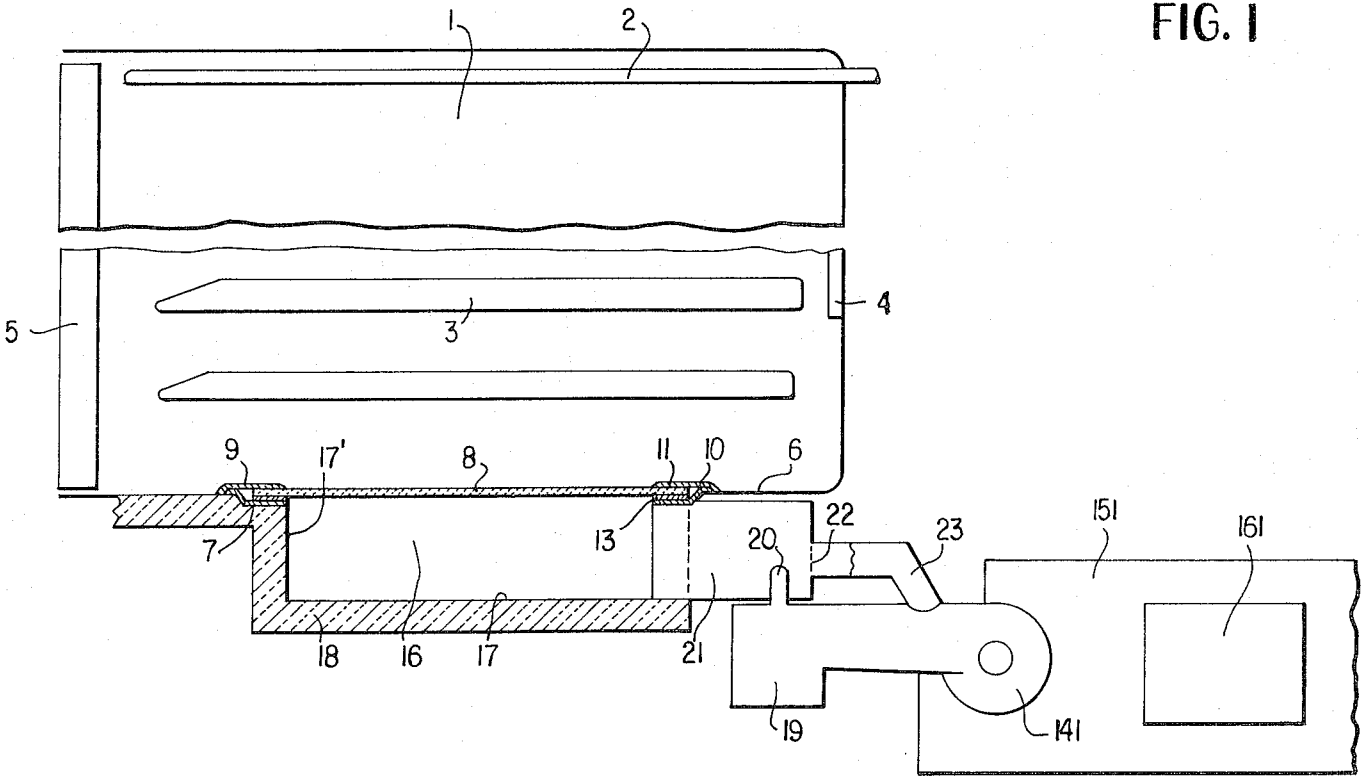
FIG. 1 is a schematic sectional side elevational view of an oven incorporating a preferred embodiment of the invention.

Turning now to FIG. 1, there is shown a cooking chamber 1 of an oven utilizing energy derived both from microwaves and from heat generated by an electric resistance heater. The latter comprises conventional electric tubular heating elements 2, arranged at the upper part of the cooking chamber. The cooking chamber further has laterally arranged guides 3 for slidable baking trays or the like as well as a rearwardly arranged mount 4 for a grill or hot air flow generating equipment, such as disclosed, for example, in U.S. Pat. No. 3,656,469. The front side of the cooking chamber 1 can be closed by an oven door 5. The bottom 6 of the cooking chamber 1 has a rectangular cutout framed by a circumferential flange 7 to thus define a microwave connecting window 16. The latter is entirely covered by a glass-ceramic plate 8 that rests on the flange 7. The glass-ceramic plate 8 is immobilized in its sunken position by a circumferential securing frame 9 which is affixed to the bottom 6. The securing frame 9 is supported on the bottom 6 and engages the glass-ceramic plate 8 with the interposition of a high-temperature resistant dual seal 10 and 11. The glass-ceramic plate 8, in turn, is positioned on the flange 7 with the intermediary of an additional seal 13. Between the glass-ceramic plate 8 and a raised edge 14 of the flange 7 there is formed a clearance 15 to permit for a free expansion of the glass-ceramic plate 8 during heating. Underneath the glass-ceramic plate 8, in the zone of the microwave window 16 there is arranged a pan-like connecting housing 17 secured to the underside of the flange 7. The outline and dimensions of the connecting housing 17 are at least approximately adapted to the window 16. The housing 17 is expediently surrounded by an insulating body 18.

A magnetron 19 is situated adjacent the housing 17 and has an antenna 20 projecting into a waveguide 21 which communicates with the space defined by the housing 17. The microwaves generated by the magnetron 19 are introduced by the antenna 20 into the waveguide 21 and are then admitted to the interior of the connecting housing 17 from which they pass into the cooking chamber 1 through the microwave window 16 covered by the glass-ceramic plate 8.

For cooling the magnetron 19 there is provided a blower 141 associated with a ventilating system 151 which passes through the oven housing and which serves for the cooling of additional electric components 161. The rear wall of the waveguide 21 is provided with apertures 22 to which is coupled an air inlet conduit 23 of the blower 141 for the purpose of positively directing the cooling-air through the openings 22 into the connecting housing 17.

Figure 2:
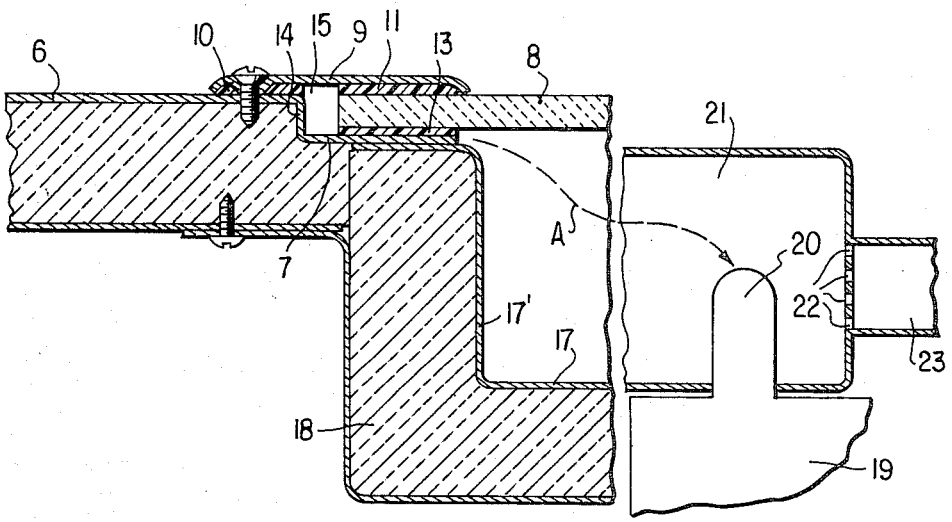
FIG. 2 is a sectional elevational view of a detail of FIG. 1 on an enlarged scale.

As noted earlier, the seals 10, 11 and 13 absorb, during the operation of the oven, grease and other impure materials which, particularly during subsequent pyrolytic heat cleaning cycles, emanate as vapors or gases from the seals and escape in all directions. During such an occurrence, and in the absence of countermeasures, the vapors and gases also penetrate into the waveguide 21 and are then capable of proceeding unimpeded to the antenna 20 of the magnetron 19 as symbolically indicated by the dash-line arrow A in FIG. 2. As a result, on the antenna 20 vapors and gases precipitate so that after a while the antenna will be covered by a dirt layer. This leads to a premature breakdown of the microwave generating device.

In order to prevent the above-described soiling of the microwave energy generating device, the rear wall of the waveguide 21 is provided with apertures 22 through which air is driven into the waveguide 21. In this manner a countercurrent or overpressure is built up, opposing the flow of the vapors and gases into the waveguide 21. Since the air introduced into the waveguide 21 through the openings 22 is taken out by a cooling air stream generated by a fan of the oven, the countercurrent or, as the case may be, the overpressure of the introduced air is substantially above the pressure of the vapors and gases escaping from the seals 10, 11 and 13. Consequently, the vapors and gases are prevented from reaching the antenna 20 of the magnetron 19 and thus the above-described soiling thereof cannot take place. Expediently, to the air inlet openings 22 there is coupled an air inlet conduit 23 for the purpose of positively directing the air through the openings 22 into the connecting housing 17. The conduit 23 communicates directly with the pressure side of the air cooling system 151 of the oven, or, in the alternative, may be connected with a separate blower.

Figure 3:
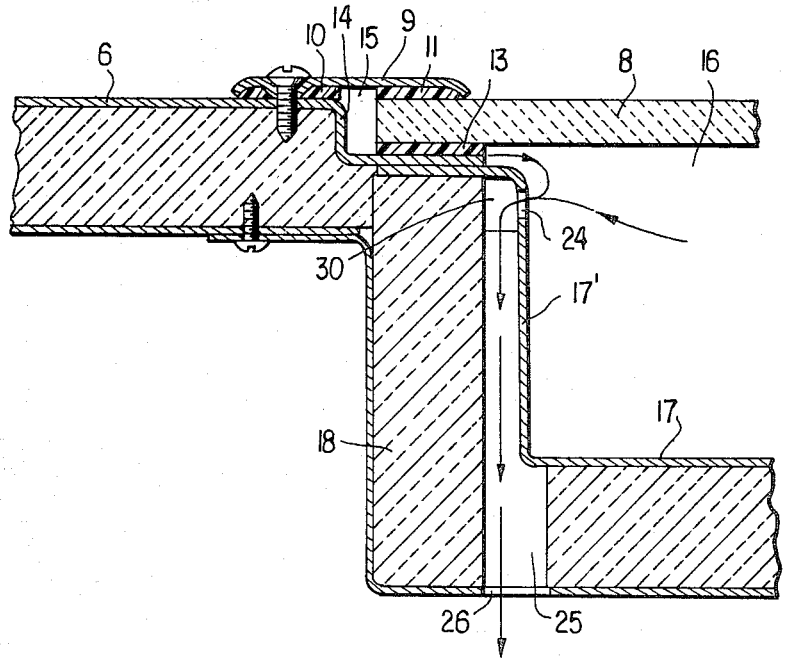
FIGS. 3, 4 and 5 are sectional side elevational views similar to FIG. 2, of further preferred embodiments of the invention.

Turning now to the embodiment illustrated in FIG. 3, in the upper zone of the side wall 17' of the bowl-shaped connecting housing 17 there are provided air outlet openings 24 which are arranged in a circumferential array about the microwave window 16 and through which the air that has passed through the waveguide 21 and the connecting housing 17 can be removed. The air outlet openings 24 communicate with an annular channel 30 provided in the insulating body 18. The channel 30, in turn, communicates with one or more vertical conduits 25 which lead to outlet openings 26 for discharging the air from the oven into the atmosphere. Since the air outlet openings 24 are situated in the immediate vicinity underneath the seal 13, the vapors and gases emanating from the seal 13 are immediately surrounded by the air stream exiting from the connecting housing 17 and entrained in the direction of the air openings 24, so that a penetration of the vapors and gases into the waveguide 21 is prevented with a very high reliability. The gases are discharged from the conduit 25 by suction or underpressure. The flow rate through the conduits 25 may be set by an appropriate dimensioning of the associated outlet opening 26.

Figure 4:
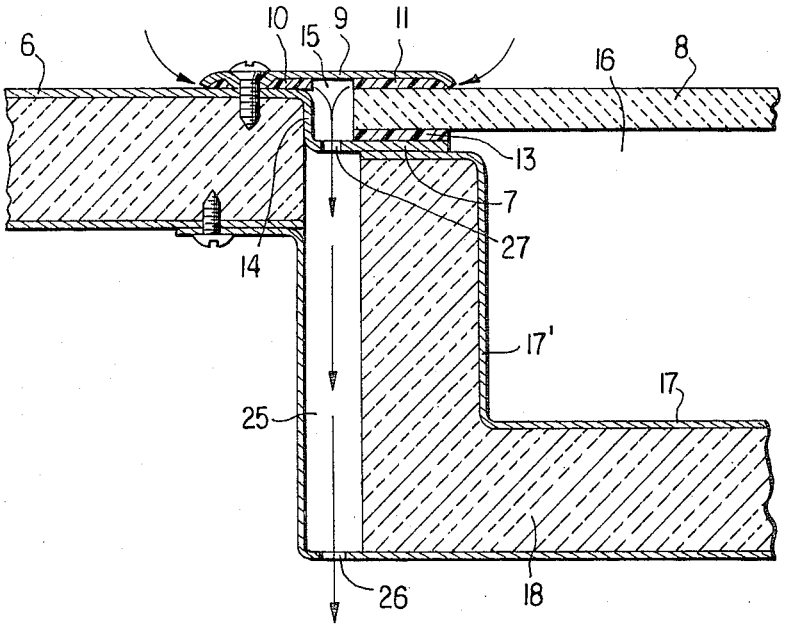

Turning now to the embodiment illustrated in FIG. 4, in the circumferential flange 7 there are provided openings 27 which maintain communication between the clearance 15 and each air discharge conduit 25. By virtue of the vacuum or underpressure generated in the conduit 25, the vapors and gases emanated from the seals 10 and 11 can be led away through the conduit 25 even before they are absorbed by the seal 13.

Figure 5:
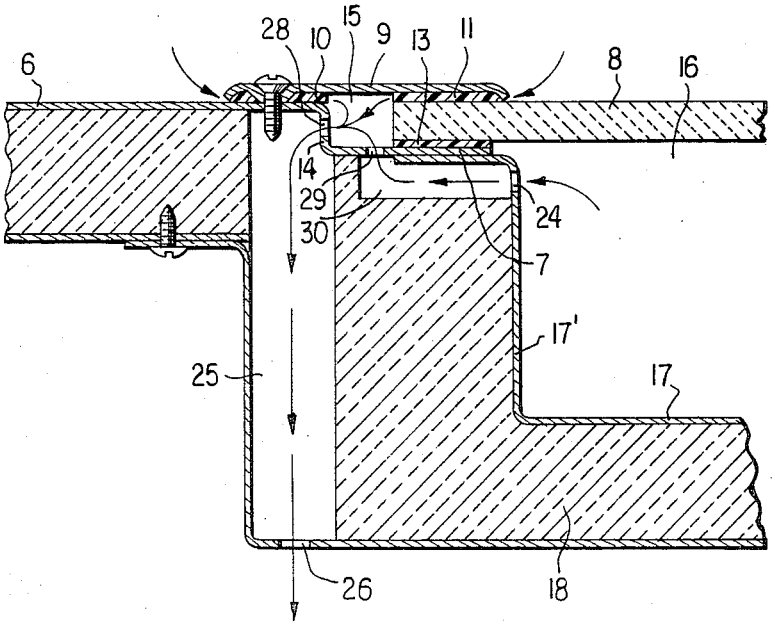

Turning now to the embodiment illustrated in FIG. 5, the clearance 15 between the plate 8 and the edge 14 of the flange 7 is, through openings 28 provided in the flange 7, in communication with the conduits 25 and, by means of further openings 29 in the flange 7, with the adjoining channel 30 and the outlet openings 24 in the lateral wall 17'. The arrangement provides that the clearance 15 which directly bounds the seals 10, 11 and 13, is continuously exposed to a fresh air flow from the cooling system of the oven, so that at those locations a grease vapor or gas accumulation cannot occur in the first place. A penetration of grease-containing substances particularly into the seal 13 which is directly at the window 16 is thus securely prevented.

It will be understood that the above description of the present invention is susceptible to various modifications, changes and adaptations, and the same are intended to be comprehended within the meaning and range of equivalents of the appended claims.

What is claimed is:

1. In an oven including walls defining a cooking chamber; means defining a microwave window in one of said walls; a glass-ceramic plate covering said window; a microwave connecting housing adjoining said window externally of said cooking chamber and defining a space bounded by parts of said sealing means; microwave generating and guiding means bounding at least in part the space defined by said connecting housing for directing microwave energy into said cooking chamber through said connecting housing and said window; and electric resistance heating means operatively connected with said cooking chamber; the improvement comprising sealing means extending along peripheral portions of said plate; means defining air inlet openings communicating with the space defined by said connecting housing and means for introducing pressurized air into said space for generating therein an air pressure affecting said parts of said sealing means.

2. An oven as defined in claim 1, further comprising an air discharge conduit and means defining air outlet openings maintaining communication between said space defined by said connecting housing and said air discharge conduit; said air outlet openings being situated in the vicinity of said sealing means, whereby a flow of pressurized air entering said space through said air inlet openings and exiting from said space through said air outlet openings is directed generally towards said sealing means.

3. An oven as defined in claim 2, further comprising an air cooling system for said oven; and means for operatively connecting said air cooling system with said air discharge conduit for generating an underpressure in said air discharge conduit.

4. An oven as defined in claim 2, wherein said air outlet openings are provided in said connecting housing generally along said sealing means.

5. An oven as defined in claim 1, wherein said microwave generating and guiding means comprises a waveguide bounding said space and opening thereinto; said waveguide including a wall containing said air inlet openings.

6. An oven as defined in claim 1, said means for introducing pressurized air comprising an air inlet conduit arranged upstream of and communicating with said air inlet openings.

7. An oven as defined in claim 1, said means defining said microwave window comprising a flange secured to said one wall of said cooking chamber; further comprising a securing frame affixed to said one wall and holding peripheral portions of said plate against said flange; and said sealing means comprising a first seal pressed between said plate and said flange and a second seal pressed between said plate and said securing frame; further wherein said flange has a raised edge portion defining a clearance with a periphery of said plate.

8. An oven as defined in claim 7, further comprising a third seal pressed between said one wall of said cooking chamber and said securing means.

9. An oven as defined in claim 7, further comprising an air discharge conduit and means defining air outlet openings maintaining communication between said clearance and said air discharge conduit.

10. An oven as defined in claim 9, further comprising means defining an annular channel surrounding said connecting housing in the vicinity of said sealing means; and means defining additional air outlet openings for maintaining communication between said space defined by said connecting housing and said clearance through said annular channel.

11. An oven as defined in claim 10, wherein said additional air outlet openings are provided in said connecting housing for maintaining communication between said space and said annular channel and further wherein said additional air outlet openings are provided in said flange for maintaining communication between said annular channel and said clearance.

12. An oven as defined in claim 2 or 9, further comprising an insulating body surrounding said connecting housing; said air discharge conduit being provided in said insulating body.

* * * * *